US012351989B2

(12) United States Patent
Henke

(10) Patent No.: US 12,351,989 B2
(45) Date of Patent: Jul. 8, 2025

(54) SPIKER ANVIL WITH TIP INSERT

(71) Applicant: NORDCO INC., Oak Creek, WI (US)

(72) Inventor: Daniel Mark Henke, Oak Creek, WI (US)

(73) Assignee: Nordco Inc.

( * ) Notice: Subject to any disclaimer, the term of this patent is extended or adjusted under 35 U.S.C. 154(b) by 241 days.

(21) Appl. No.: 17/657,984

(22) Filed: Apr. 5, 2022

(65) Prior Publication Data

US 2022/0349129 A1 Nov. 3, 2022

Related U.S. Application Data

(60) Provisional application No. 63/181,010, filed on Apr. 28, 2021.

(51) Int. Cl.
*E01B 29/26* (2006.01)

(52) U.S. Cl.
CPC ..... *E01B 29/26* (2013.01)

(58) Field of Classification Search
CPC ..... E01B 29/26; B23Q 9/0042; B23Q 9/0007; B25B 5/082; B25B 5/101; B25B 21/00; B25B 21/002; B25B 25/005; E01D 6/00
USPC ..... 173/90, 93, 115, 128–129, 133, 137
See application file for complete search history.

(56) References Cited

U.S. PATENT DOCUMENTS

| | | | | |
|---|---|---|---|---|
| 1,775,917 | A | 9/1930 | Rudlin | |
| 2,053,508 | A | 9/1936 | Barney et al. | |
| 2,272,760 | A | 2/1942 | Allen | |
| 3,827,509 | A | 8/1974 | Larson | |
| 4,579,061 | A | 4/1986 | Dieringer | |
| 4,777,885 | A | 10/1988 | Dieringer | |
| 5,191,840 | A | 3/1993 | Cotic et al. | |
| 5,671,679 | A | 9/1997 | Straub et al. | |
| 6,557,653 | B2 | 5/2003 | Hauptmann et al. | |
| 7,104,200 | B2 | 9/2006 | Hosking et al. | |
| 9,771,690 | B2 | 9/2017 | Henke | |
| 2009/0211812 | A1* | 8/2009 | Puttmann | E21B 4/145 175/21 |
| 2015/0053449 | A1* | 2/2015 | Henke | E01B 29/26 173/128 |

FOREIGN PATENT DOCUMENTS

| | | |
|---|---|---|
| JP | 5270276 B2 | 5/2013 |

* cited by examiner

*Primary Examiner* — Eronica Martin
(74) *Attorney, Agent, or Firm* — K&L Gates, LLP

(57) ABSTRACT

A spiker anvil is provided for use in a rail fastener driving workhead unit. Included in the present spiker anvil is a head with an outer periphery, the head outer periphery including an indentation that mates with a hammer pin of the rail fastener driving workhead unit. Also included in the spiker anvil is a body defining a body outer periphery and a tip defining a tip outer periphery, a substantially flat bottom surface, a first chamfer and a second chamfer, the bottom surface being perpendicular to the tip outer periphery, and the first and second chamfer connecting the bottom surface and the tip outer periphery. Further, the spiker anvil includes a cavity within the tip with an opening in the bottom surface and an insert placed within the cavity, such that the insert includes an end which extends beyond the bottom surface.

20 Claims, 5 Drawing Sheets

SPIKER ANVIL WITH TIP INSERT

RELATED APPLICATION

The present application is a Non-Provisional of, and claims priority under 35 U.S.C. 119 based on U.S. Provisional Patent Application Ser. No. 63/181,010 filed Apr. 28, 2021, the contents of which are incorporated by reference herein.

BACKGROUND

The present disclosure generally relates to railway maintenance equipment, particularly rail spike driving apparatus. More specifically, the present disclosure provides an improved rail spiker anvil.

Rail fasteners as contemplated herein include cut spikes, lag screws, hairpin spikes and other types of rail fasteners used for retaining tie plates upon ties, and rails upon tie plates, as are known to skilled practitioners. In some cases in the specification, "spikes" may be used interchangeably with "rail fasteners." The use of the term "spikes" is not intended to limit the scope of the present disclosure.

During the course of railroad maintenance work, it is common that existing rail fasteners are removed for replacement of rail ties, tie plates, rails and for other maintenance operations. Once the desired maintenance is complete, and usually, replacement wooden ties are inserted under the rails, the fasteners need to be reinstalled. For installing the fasteners, a conventional spike driving workhead unit employs an elongated shaft-like anvil, often referred to as a spiker anvil, which is vertically reciprocating relative to a spotting carriage to drive the fasteners into the ties. Several types of rail fastener applicators or drivers are known, and exemplary models are described in commonly assigned U.S. Pat. Nos. 4,579,061; 4,777,885; 5,191,840; 5,671,679; and 7,104,200, all of which are incorporated by reference herein. Such machines are either self-propelled or towed along the rails, and are equipped with at least one, and preferably multiple spike-driving workhead units, each having a spiker anvil.

Under the vertically reciprocating action of a hydraulic impact hammer, the spiker anvil repeatedly applies downward pressure upon spikes in a pushing or percussion function. After extended use, a spike engagement end of the anvil wears out and thus the anvil needs to replacement. Existing spike driving workhead units are designed to aid in the replacement of the spiker anvil, such as disclosed in U.S. Pat. No. 9,771,690 which is incorporated by reference.

However, replacing the entire spiker anvil is expensive and wasteful, as usually it is only the tip of the spiker anvil that becomes worn down with use. Accordingly, the remainder of the spiker anvil remains in in perfectly functional condition. With traditional spiker anvils, which are a single integrated unit, it is either expensive or impossible to repair the tip of the anvil once it is worn down. The spike driving workhead unit includes a bracket which aligns the spiker anvil and helps it remains in contact with the head of the spikes.

Existing spiker anvils are subject to extensive mushrooming Specifically, after the spiker anvil has been used for a period of time, the tip tends to become compressed and balloons outward. Mushrooming creates two problems. First, it reduces the operational length of the anvil, which decreases the impact force generated by the hammer More specifically, inside the spiker hammer is a nitrogen charged bladder that provides the impact energy to drive the spike. When the anvil wears, it is unable to fully compress the bladder. Thus, using a worn, mushroomed anvil, more strikes are needed to drive a single spike, slowing the track repair operation. In some cases, the operator can audibly note the difference in sound generated by a mushroomed anvil. Second, mushrooming makes the anvil extremely difficult to remove, since it will no longer slide through the workhead bracket. Thus, the tip of the anvil has to be cut before it can be removed from the spiker workhead. Accordingly, there is a need for an improved spiker anvil which addresses the above-identified design parameters.

SUMMARY

The above-listed need is met or exceeded by the present spiker anvil with tip insert. Specifically, the present spiker anvil includes a body with an outer periphery that is significantly reduced compared to a head of the spiker anvil. Since the body has a reduced diameter, it is configured to fit within the aligning bracket of conventional spike driving workhead units. At the same time, the present spiker anvil has a counterbored tip that is dimensioned to accommodate a relatively hardened insert. In the preferred embodiment, the insert is press fit to be held in the anvil via friction. It is preferred that the tip insert is dimensioned to impact the head of the rail spike. The surrounding anvil material defining the counterbore needs to be sufficiently thick to support and retain the insert, at the same time the anvil needs to slidingly engage the workhead bracket.

Additionally, since the insert impacts the spike, the relatively hardened material is not subject to the unwanted mushrooming described above. Further, since the relatively softer anvil material does not impact the spike, mushrooming has not been detected. To further reduce the chance of mushrooming, the tip of the spiker anvil includes a dual chamfer design that allows for gradual reducing in diameter from the outer diameter of a bottom surface of the spiker anvil to a main diameter of the body of the anvil. By providing a gradual increase in diameter from the spiker anvil bottom surface to the main spiker anvil body, there is a reduced likelihood of mushrooming by the insert. Specifically, the surface area of the bottom surface relative to the diameter of the body is relatively large, thereby providing additional carrier material around the insert, while keeping the overall diameter of the spiker anvil body small. In addition, the present spiker anvil is designed such that an end of the relatively hardened insert extends a distance beyond the bottom surface of the spiker anvil for impacting spike heads.

More specifically, a spiker anvil is provided for use in a rail fastener driving workhead unit. Included in the present spiker anvil is a head with an outer periphery, the head outer periphery including an indentation that mates with a hammer pin of the rail fastener driving workhead unit. Also included in the spiker anvil is a body defining a body outer periphery and a tip defining a tip outer periphery, a substantially flat bottom surface, a first chamfer and a second chamfer, the bottom surface being perpendicular to an axis of the body, and the first and second chamfers connecting the bottom surface and the tip outer periphery. Further, the spiker anvil includes a cavity or counterbore within the tip with an opening in the bottom surface. An insert is placed within the cavity, such that the insert includes an impact end which extends beyond the bottom surface.

In a preferred embodiment, the tip outer periphery has a diameter that is smaller than a diameter of the body outer periphery, and the body outer periphery diameter is less than half of a diameter of the head outer periphery. In another preferred embodiment, a ratio of a diameter of the insert to the body outer periphery diameter is greater than 0.5:1. Alternatively, in preferred embodiments, the first and second chamfers have a combined length in a direction along the central axis of the anvil body of 0.35 inches or less, the first chamfer has an angle of 60° with respect to the bottom surface, and the second chamfer has an angle of 80° with respect to the bottom surface. Preferably, the insert is shrink fit or press fit into the cavity, and the cavity includes an insert locator which extends into the cavity and mates with a corresponding receptacle in the insert. Preferably still, the insert is made of DC53 tool steel, and the body is made of AISI 4340 alloy steel. In a further preferred embodiment, the end of the insert extends beyond the bottom surface by 0.13 inches or less.

A second embodiment of the present disclosure includes a spiker anvil provided for use in a rail fastener driving workhead unit. The spiker anvil includes a head with an outer periphery, the head outer periphery including an indentation that mates with a hammer pin of the rail fastener driving workhead unit. Also included in the spiker anvil is a body with a body outer periphery and a tip with a tip outer periphery, a substantially flat bottom surface, a first chamfer and a second chamfer, the bottom surface being perpendicular to an axis of the body. Moreover, the first and second chamfers connect the bottom surface and the tip outer periphery, and the first and second chamfers have a combined length in a direction along a central axis of said anvil body of 0.35 inches or less. The spiker anvil further includes a cavity within the tip with an opening in the bottom surface and an insert placed within the cavity, an end of the insert extending beyond the bottom surface by 0.13 inches or less. Further, a ratio of a diameter of the insert to a diameter of the body outer periphery is greater than 0.5:1.

A third embodiment of the present disclosure includes a fastener driving workhead unit provided for performing an operation on spikes of a railroad track having a plurality of ties. The workhead unit includes a hammer housing configured for accommodating a hammer, the housing being attached to a hammer bushing having a hammer bushing clamp, such that the hammer bushing clamp is dimensioned for insertion into a bushing side cavity of the hammer bushing. Also included in the workhead unit is an anvil assembly having an anvil and an extension coupler, the extension coupler being releasably secured to the hammer bushing by fastening the hammer bushing clamp. Additionally, the anvil includes a head with an outer periphery, the head outer periphery including an indentation that mates with a hammer pin of the rail fastener driving workhead unit, and a body with a body outer periphery. Moreover, the anvil has a tip with a tip outer periphery, a substantially flat bottom surface, a first chamfer and a second chamfer, the bottom surface being perpendicular to the tip outer periphery, and the first and second chamfers connecting the bottom surface and the tip outer periphery. Further, the anvil includes a cavity within the tip with an opening in the bottom surface and an insert placed within the cavity, such that the insert includes an end which extends beyond the bottom surface.

DETAILED DESCRIPTION

Figure 1:
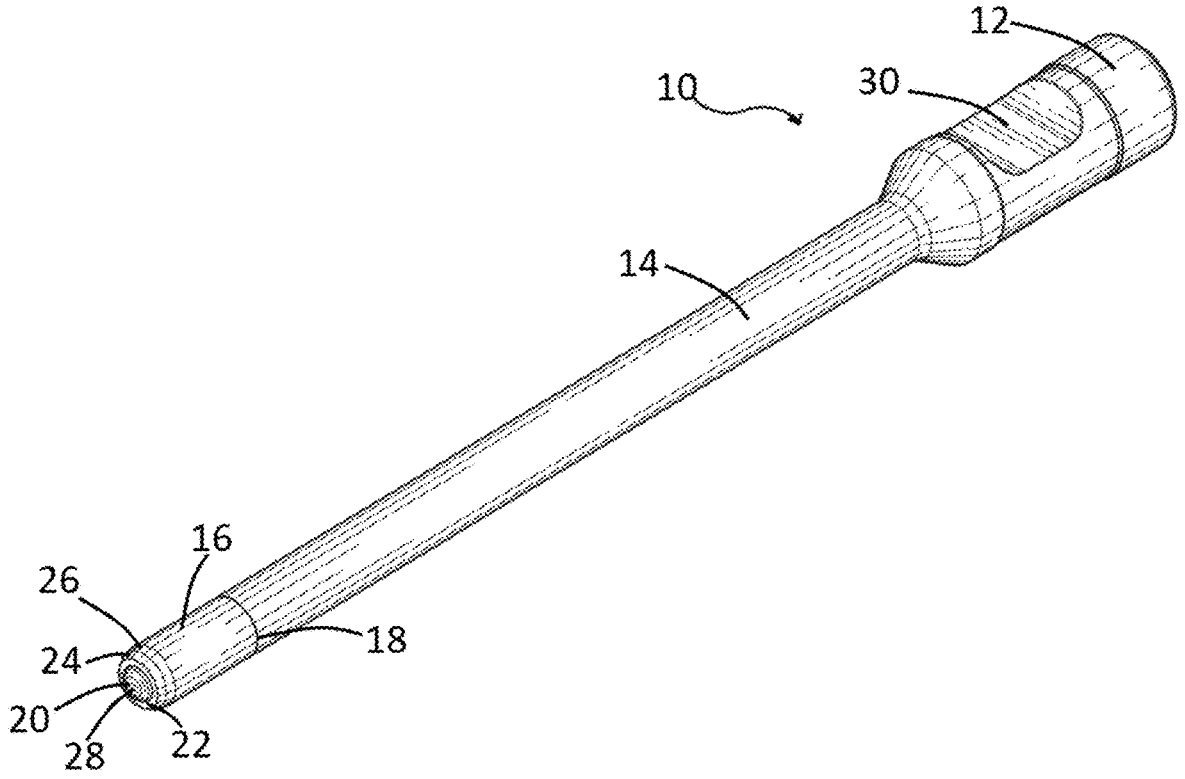
FIG. 1 is a top perspective view of the present spiker anvil with tip insert.
Figure 5:
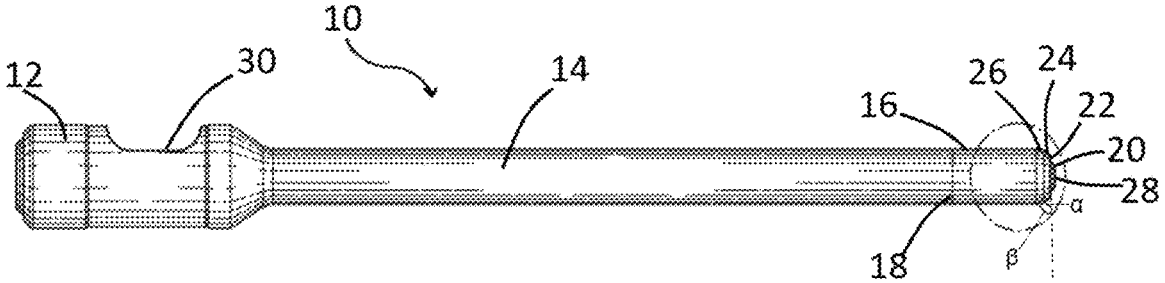
FIG. 5 is a side view of the spiker anvil with tip insert of FIG. 1.

Referring now to FIGS. 1 and 5, the present spiker anvil with tip insert is generally designated 10. The spiker anvil 10 includes a head 12 with an outer periphery, a body 14 with a body outer periphery, and a tip 16 with a tip outer periphery. Additionally, a separation line 18 separates the tip 16 from the body 14. In a preferred embodiment, the separation line 18 is a significant feature, as a diameter of the tip outer periphery is slightly smaller than a diameter of the body outer periphery. Accordingly, in this preferred embodiment, the separation line 18 is demarcates the body 14 and the tip 16, as the slightly smaller diameter of the tip outer periphery is important for allowing the spiker anvil 10 to properly function within a rail fastener driving workhead unit, as will be discussed in greater detail below.

The spiker anvil 10 also includes an insert 20 which extends beyond a substantially flat bottom surface 22 of the tip 16. Additionally, the bottom surface 22 is connected to the tip 16 outer periphery by way of a first chamfer 24 and a second chamfer 26 that allow for a gradual increase in diameter from the outer diameter of the bottom surface 22 to the tip outer periphery. Further, the insert 20 includes an end 28 that contacts the spike (not shown). Preferably, the end 28 of the insert 20 extends beyond the bottom surface 22, and more preferably extends less than 13 inches beyond the bottom surface 22. Moreover, the spiker anvil 10 includes an indentation 30 in the head 12 that is intended to accommodate a hammer pin (not shown) within the rail fastener driving workhead unit as is known in the art.

Figure 2:
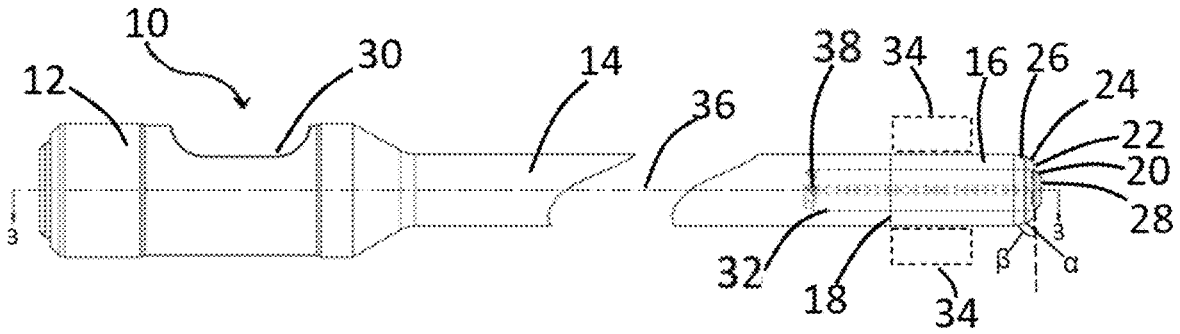
FIG. 2 is a fragmentary side view of the spiker anvil with tip insert of FIG. 1.

Referring now to FIG. 2, the spiker anvil 10 includes a cavity or counterbore 32 which houses and accommodates the insert 20. As mentioned above, the spiker anvil 10 is used within a rail fastener driving workhead unit, such as the one described in U.S. Pat. No. 9,771,690 and shown in FIG. 10. Conventional rail fastener driving workhead units include a spiker anvil that is a unitary piece, such that when the tip of the spiker anvil wears down, the entire spiker anvil must be replaced. This is expensive and wasteful, as the majority of the spiker anvil is in working condition when the tip fails. Therefore, the present spiker anvil 10 features the insert 20 which significantly extends the working life of the anvil 10 compared to conventional units, and reduces the cost of operating the rail fastener driving workhead. Another important feature of the present spiker anvil 10 is the ability to function properly while having a tip 16 outer periphery that has a relatively small diameter. Specifically, the anvil 10 fits within a locating bracket 34 of the workhead unit, which dictates the maximum allowable size of the tip outer periphery. Accordingly, the diameter of the tip outer periphery has to be sufficiently small to slideably engage the bracket 34, while at the same time satisfactorily supporting and retaining the insert 20.

Rather unexpectedly, the present spiker anvil 10 provides a relatively small tip outer periphery while still maintaining sufficient carrier material to adequately house and retain the insert 20. As discussed above, for a preferred embodiment, the separating line 18 is important, as it demarcates the tip 16 from the body 14. Additionally, in embodiments where the tip outer periphery is slightly smaller than the body 14 outer periphery, the separating line 18 creates a small lip, which forms a stop for the locating bracket 34.

Also, there is a central longitudinal axis 36 which runs along the length of the anvil body 14. It is with respect to the axis 36 that various lengths of the spiker anvil 10 are measured. Specifically, the length of the first and second chamfers 24, 26 is measured along the axis 36. In a preferred embodiment, the first and second chamfer have a combined length along the axis 36 of 0.35 inches. This short length further accounts for the small diameter of the tip 16 outer periphery, as the first and second chamfers 24, 26 connect the bottom surface 22 and the tip outer periphery. Additionally, the cavity 32 preferably includes an insert locator 38, which enhances location of the insert 20 within the cavity 32.

Figure 3:
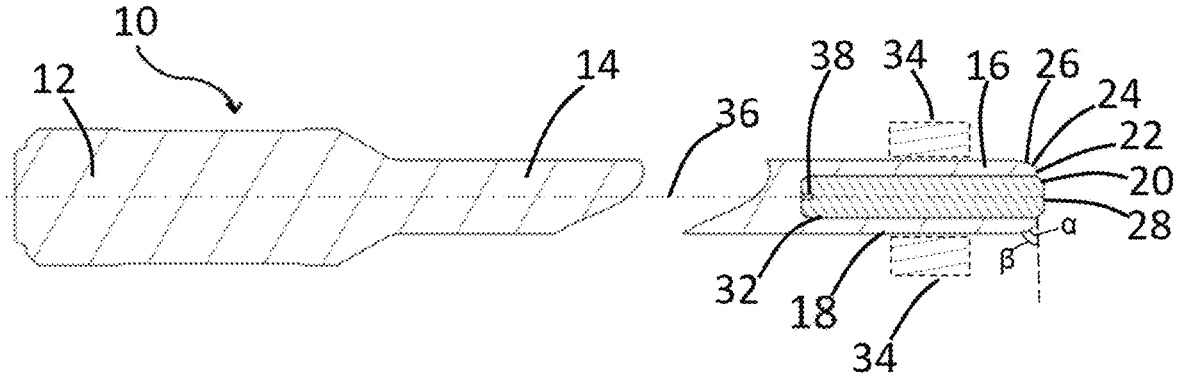
FIG. 3 is a cross-section of the present spiker anvil with tip insert taken generally along the line 3-3 in FIG. 2 and in the direction generally indicated.
Figure 7:
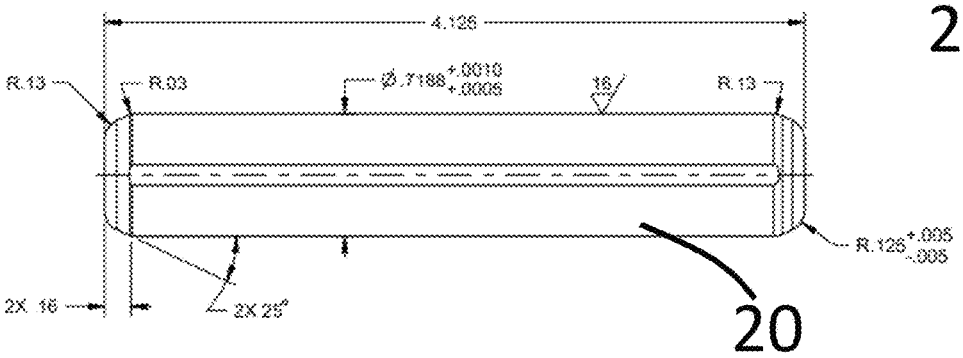
FIG. 7 is a side plan view of the present tip insert.
Figure 9:
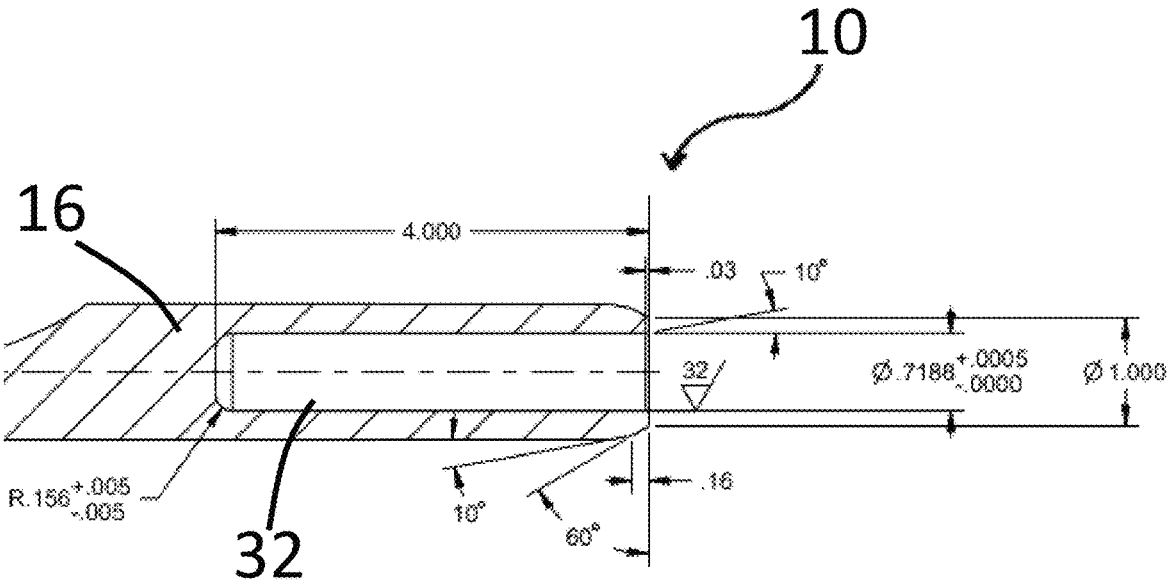
FIG. 9 is a vertical cross-section of the spiker anvil without the tip insert.

As can be seen in FIGS. 3, 7 and 9, the insert 20 is tightly fit within the cavity 32. This is accomplished either by shrink fitting, press fitting, or any other method for friction fitting and retaining the insert 20 into the cavity 32 as is known in the art. Additionally, FIG. 3 illustrates the relative diameters of the insert 20 and the tip outer periphery. In a preferred embodiment, a ratio of the diameter of the insert 20 relative to the diameter of the tip outer periphery is 0.5:1. Put another way, in this preferred embodiment, the diameter of the insert 20 is half the size of the diameter of the tip outer periphery. Other ratios of the diameter of the insert 20 relative to the diameter of the tip outer periphery are contemplated.

Figure 4:
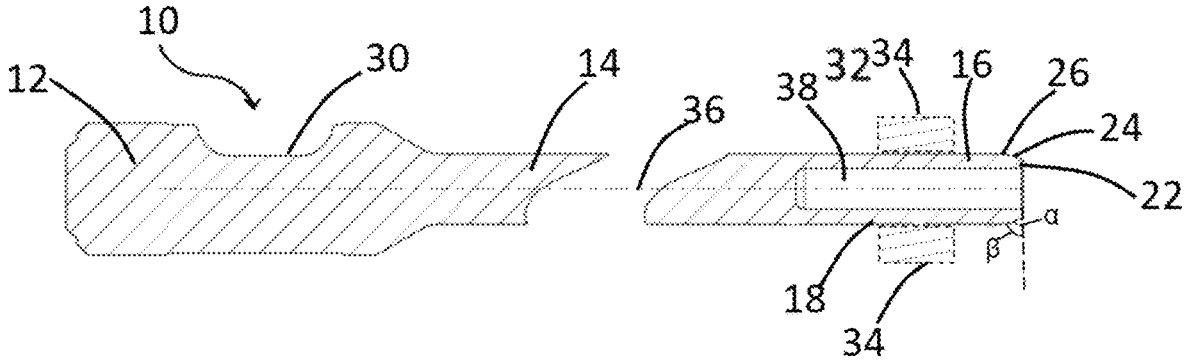
FIG. 4 is a fragmentary cross-sectional view of the present spiker anvil without the tip insert.

Referring now to FIG. 4, the relative outer peripheral diameters of the head 12, the body 14, and the tip 16 are illustrated. As discussed above, the diameter of the body outer periphery is preferably slightly larger than the tip outer periphery. However, other dimensional relationships are contemplated. Additionally, the body outer periphery diameter is either equal to or smaller than the head outer periphery diameter. In a preferred embodiment, the diameter of the body outer periphery is less than half of that of the head outer periphery.

Figure 6:
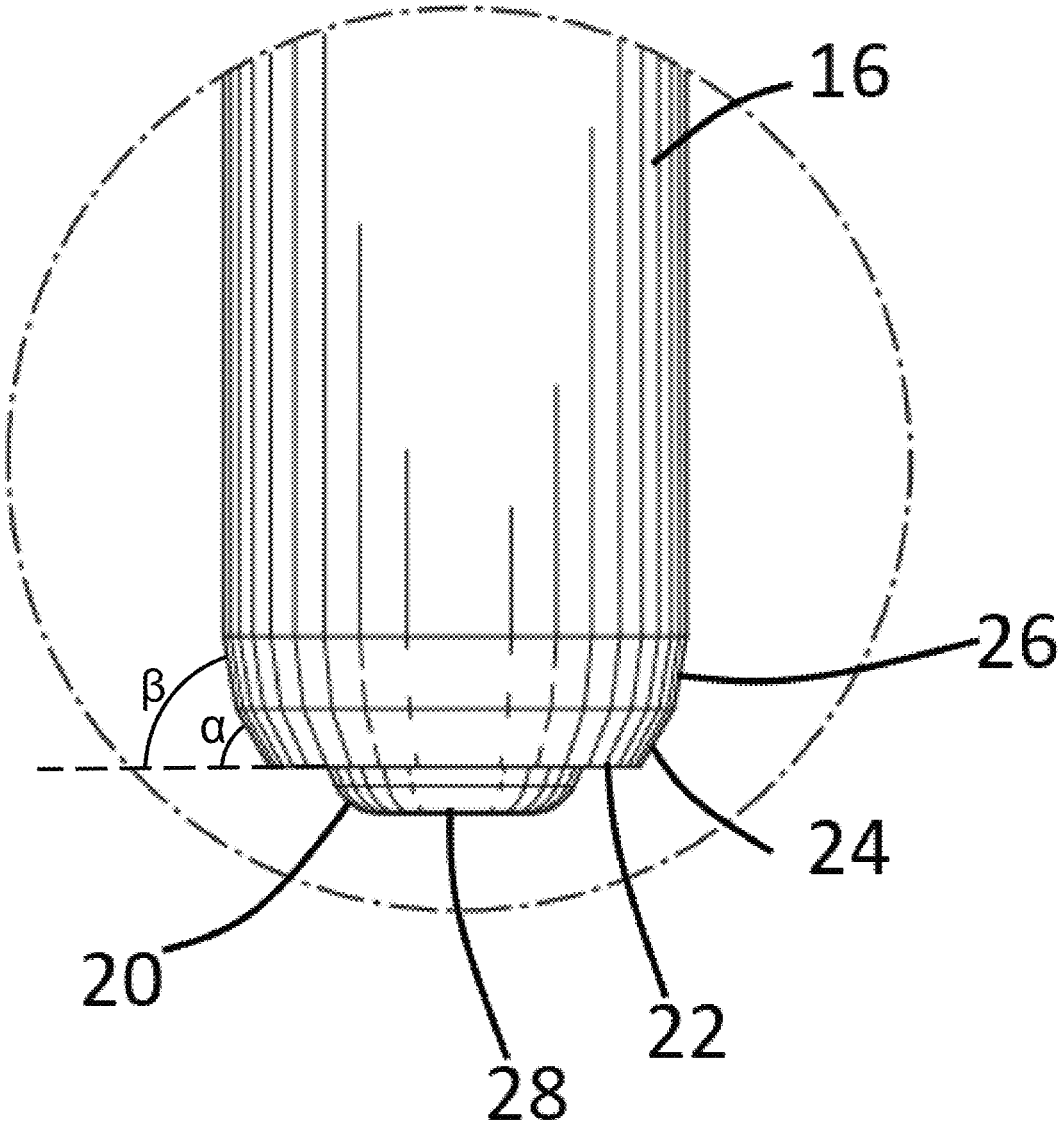
FIG. 6 is an enlarged fragmentary view of the spiker anvil with tip insert of FIG. 5.

Referring now to FIG. 6, the configuration of the first and second chamfers 24, 26 are shown in relation to the tip outer periphery and the bottom surface 22. In a preferred embodiment, the first chamfer 24 has an angle $\alpha$ of 60° with respect to the bottom surface 22 and the second chamfer 26 has an angle $\beta$ of 80° with respect to the bottom surface 22. However, other sizes for angles $\alpha$ and $\beta$ for the first and second chamfers 24, 26 are contemplated. FIG. 6 also illustrates the end 28 of the insert 20 extending beyond the bottom surface 22 of the tip 16.

Figure 8:
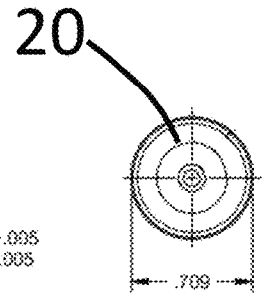
FIG. 8 is a front plan view of the tip insert of FIG. 7.

Referring now to FIGS. 7-9, while other dimensions are contemplated depending on the application, dimensions of a preferred embodiment of the insert 20 and the tip 16 are illustrated. Each of the length and radii dimensions illustrated in FIGS. 7-9 are in inches. Of particular importance are the diameter of the insert 20, the diameter of the outer edge of the bottom surface 22, and the length of the insert 20 and cavity 32. As before, the length of the cavity 32 and the insert 20 are defined relative to the central axis 36 of the anvil body 14. Also, FIGS. 7 and 9 illustrate the various angles and radii of the spiker anvil 10 components. Various hard materials are considered for use as the insert 20 and the remainder of the anvil 10. However, a preferred material for the insert 20 is DC53 tool steel. Similarly, a preferred material for the remainder of the anvil 10, including the body 14, is AISI 4340 alloy steel. However, other sufficiently hard materials, are contemplated as the material for the insert 20 and the anvil 10 as are well known in the art.

Figure 10:
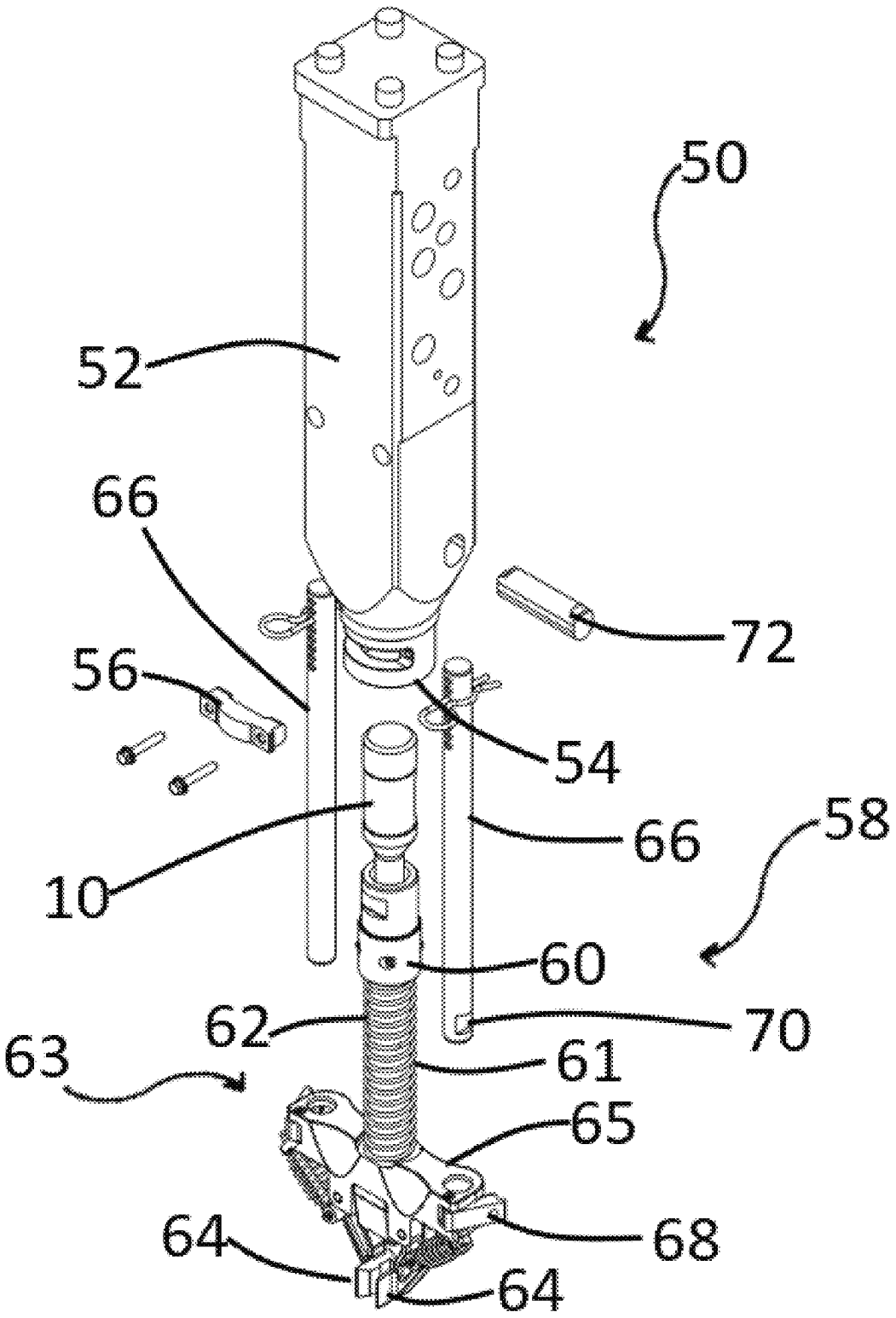
FIG. 10 is a front exploded perspective view of a spike driving workhead unit suitable for use with the present spiker anvil.

Referring now to FIG. 10, another embodiment of the present disclosure includes a present spike driving workhead unit, which is generally designated 50 and is designed to drive railroad spikes (not shown) into railroad ties (not shown). Included in the unit 50 is a hammer housing 52 for accommodating a hydraulic impact hammer (not shown) which is reciprocally vertically movable to drive spikes into wooden rail ties. The hammer housing 52 is attached to a hammer bushing 54 having a hammer bushing clamp 56. While other suitable shapes are contemplated, it is preferred that the hammer bushing 56 has a substantially cylindrical shape for accommodating an extension coupler 58. The extension coupler 58 is releasably secured to the hammer bushing 56. This may be through the use of two fasteners, the use of a single fastener and a pivot, or other means as are known in the art.

An anvil assembly, generally designated 60, includes the extension coupler 58 at its upper end. Further included in the anvil assembly 60 is a tube-like anvil sleeve 61 that defines a passageway for the present anvil 10 within the sleeve 61. In operation, the anvil 10 travels reciprocally vertically inside the sleeve 61 to matingly engage the head of the spike. Further included in the anvil assembly 60 is a spring 62 that surrounds the anvil sleeve 61, and is connected at one end to the extension coupler 60 and at an opposite end to a jaw assembly, generally designated 63. More specifically, the spring 62 biases at its upper end the extension coupler 60, and also biases at its lower end the jaw assembly 63. When the jaw assembly 63 is in an open position, the sleeve 61 holds the spike inside the sleeve during percussion, and subsequently the spike is driven into the tie.

Included in the jaw assembly 60 is a pair of spike gripping jaws 64 mounted to a jaw block 65. In operation, the jaws 64 are pressurized toward the closed or gripping position by a pair of rod eyes which are hydraulically or mechanically biased, e.g., spring biased, as is well known in the art. A plurality of guide rods 66 fit within throughbores in the jaw block 63. The rods 66 guide a vertical movement of the anvil assembly 58 during percussing operation of the spike driving workhead unit 10. Also, the rods 66 guide the downward movement of the jaw assembly 63 to a spiking position. As is known in the art, the guide rods 66 are slidingly engaged in corresponding bores of a workhead feeder frame of the type disclosed in U.S. Pat. No. 5,398,616, incorporated by reference. While other configurations are contemplated, it is preferred that two throughbores are provided in the jaw block 63 for the accommodation of two of the guide rods 66 for each spike driving workhead unit 10. A lower end of each guide rod 66 matingly engages a corresponding throughbore, and is secured to the jaw block 65 by pivotally fastening a corresponding jaw block clamp 68 as described in further detail below.

During operation, the lower end of each guide rod 42 is releasably attached to the jaw block 65 by fastening the corresponding jaw block clamp 68 using a transverse threaded fastener, such as a bolt. A rod indentation 70 is disposed at each lower end of the guide rod 66 for mating with a matching indentation of the jaw block clamp 68.

Typically, the spike driving workhead unit 60 is attached to a cylinder (not shown) via a sled (not shown) for upward and downward movements. A stroke range of the cylinder is between 18" and 19.5", but preferably 19.5". The sleeve 61 is firmly attached to the hammer housing 52 through the extension coupler 60 and the hammer bushing 54. The sleeve 61 travels in upward and downward directions along an operation axis of the hammer housing 52. Inside the sleeve 61 is the anvil 10, and it freely reciprocates in the hammer housing 52. Specifically, the head 12 of the anvil 10 has the indentation 30 that mates with a hammer pin 72. As best shown in FIG. 10, the hammer pin 72 preferably has a cylindrical shape with a guiding planar upper surface and is configured for mating with the anvil indentation 30 when the hammer pin 72 is inserted into a corresponding hole in the hammer housing 52.

The jaw assembly 63 and the guide rods 66 travel downwardly under the action of the spring 62 biasing between the extension coupler 60 and the jaw block 65. A purpose of the spring 62 is to keep the jaw assembly 63 and the guide rods 66 traveling at the same speed as the hammer housing 52, the sleeve 61, and the cylinder so that the spike is held securely. A length of the spring 62 does not change when the spike driving workhead unit 50 moves downwardly to the spiking position until a pair locking pins hit the top of a bushing weldment (not shown). At this time, the sleeve 61, the hammer housing 52, and the anvil 10 continue to descend, and the spring 62 starts to compress. Then, the jaws 63, which are spring biased (not shown), start to open as the sleeve 61 is passing though the jaws 63. At this time, the spike driving workhead unit 50 receives resistance from the spike head, and this triggers the anvil 10 for driving the spike into the tie.

While a particular embodiment of the present spiker anvil with tip insert has been described herein, it will be appreciated by those skilled in the art that changes and modifications may be made thereto without departing from the invention in its broader aspects and as set forth in the following claims.

The invention claimed is:

1. A spiker anvil for use in a rail fastener driving workhead unit, comprising:

a head comprising a head outer periphery, said head outer periphery including an indentation that mates with a hammer pin of the rail fastener driving workhead unit;

a body defining a body outer periphery;

a tip defining a tip outer periphery, a bottom surface, a first chamfer and a second chamfer, said bottom surface being perpendicular to said tip outer periphery, said first chamfer being oriented at a first angle relative to said bottom surface, said second chamfer being oriented at a second angle relative to said bottom surface, said first and second angles being different angles, and said first and second chamfers connecting said bottom surface and said tip outer periphery;

a cavity within said tip having an opening in said bottom surface; and an insert placed within said cavity, such that said insert includes an end which extends beyond said bottom surface.

2. The spiker anvil according to claim 1, wherein said tip outer periphery has a diameter that is smaller than a diameter of said body outer periphery, and wherein said body outer periphery diameter is less than half of a diameter of said head outer periphery.

3. The spiker anvil according to claim 1, wherein a ratio of a diameter of said insert to a diameter of said body outer periphery is greater than 0.5:1.

4. The spiker anvil according to claim 1, wherein said first and second chamfers have a combined length in a direction along a central axis of said spiker anvil of 0.35 inches or less.

5. The spiker anvil according to claim 3, wherein said first chamfer has an angle of 60 degrees with respect to said bottom surface and said second chamfer has an angle of 80 degrees with respect to said bottom surface.

6. The spiker anvil according to claim 1, wherein said insert is shrink fit or press fit into said cavity.

7. The spiker anvil according to claim 1, wherein said cavity includes an insert locator which extends into said cavity and mates with a corresponding receptacle in said insert.

8. The spiker anvil according to claim 1, wherein said insert is made of DC53 tool steel.

9. The spiker anvil according to claim 1, wherein said body is made of AISI 4340 alloy steel.

10. The spiker anvil according to claim 1, wherein said end of said insert extends beyond said bottom surface by 0.13 inches or less.

11. The spiker anvil according to claim 1, wherein said tip is a seamless body.

12. A spiker anvil for use in a rail fastener driving workhead unit, comprising:

a head comprising a head outer periphery, said head outer periphery including an indentation that mates with a hammer pin of the rail fastener driving workhead unit;

a body defining a body outer periphery;

a tip defining a tip outer periphery, a bottom surface, a first chamfer and a second chamfer, said bottom surface being perpendicular to said tip outer periphery, said first chamfer being oriented at a first angle relative to said bottom surface, said second chamfer being oriented at a second angle relative to said bottom surface, said first and second angles being different angles, said first and second chamfers connecting said bottom surface and said tip outer periphery, and said first and second chamfers have a combined length in a direction along a central axis of said spiker anvil of 0.35 inches or less;

a cavity within said tip having an opening in said bottom surface; and an insert placed within said cavity, an end of said insert extending beyond said bottom surface by 0.13 inches or less, and a ratio of a diameter of said insert to a diameter of said body outer periphery is greater than 0.5:1.

13. The spiker anvil according to claim 12, wherein said first chamfer has an angle of 60 degrees with respect to said bottom surface and said second chamfer has an angle of 80 degrees with respect to said bottom surface.

14. The spiker anvil according to claim 12, wherein said insert is made of DC53 tool steel.

15. The spiker anvil according to claim 12, wherein said spiker anvil is made of AISI 4340 alloy steel.

16. The spiker anvil according to claim 12, wherein said insert is press fit or shrink fit into said cavity.

17. The spiker anvil according to claim 12, wherein said cavity includes an insert locator which extends into said cavity and mates with a corresponding receptacle in said insert.

18. The spiker anvil according to claim 12, wherein said tip outer periphery has a diameter that is smaller than a diameter of said body outer periphery, and wherein said body outer periphery diameter is less than half of a diameter of said head outer periphery.

19. The spiker anvil according to claim 12, wherein said tip is a seamless body.

20. A fastener driving workhead unit for performing an operation on spikes of a railroad track having a plurality of ties, comprising:

a hammer housing configured for accommodating a hammer, said hammer housing being attached to a hammer bushing having a hammer bushing clamp, such that said hammer bushing clamp is dimensioned for insertion into a bushing side cavity of said hammer bushing; and an anvil assembly having an anvil and an extension coupler, said extension coupler being releasably secured to said hammer bushing by fastening said hammer bushing clamp, said anvil comprising:

a head comprising a head outer periphery, said head outer periphery including an indentation that mates with a hammer pin of said fastener driving workhead unit;

a body defining a body outer periphery;

a tip defining a tip outer periphery, a bottom surface, a first chamfer and a second chamfer, said bottom surface being perpendicular to said tip outer periphery, said first chamfer being oriented at a first angle relative to said bottom surface, said second chamfer being oriented at a second angle relative to said bottom surface, said first and second angles being different angles, and said first and second chamfers connecting said bottom surface and said tip outer periphery;

a cavity within said tip with an opening in said bottom surface; and an insert placed within said cavity, such that said insert includes an end which extends beyond said bottom surface.

* * * * *